US007740246B1

(12) United States Patent
Walterscheid

(10) Patent No.: US 7,740,246 B1
(45) Date of Patent: Jun. 22, 2010

(54) NOVELTY GOLFING DEVICE HAVING MAGNETIC PROJECTILE

(76) Inventor: Steve Walterscheid, P.O. Box 530, Bend, OR (US) 97106

( * ) Notice: Subject to any disclaimer, the term of this patent is extended or adjusted under 35 U.S.C. 154(b) by 0 days.

(21) Appl. No.: 12/253,227

(22) Filed: Oct. 16, 2008

Related U.S. Application Data

(60) Provisional application No. 60/999,174, filed on Oct. 16, 2007.

(51) Int. Cl.
*A63F 7/06* (2006.01)
*A63B 63/00* (2006.01)

(52) U.S. Cl. ..... 273/317.2; 273/108.21; 273/108.22; 273/348.5; 273/129 V; 273/405

(58) Field of Classification Search .... 273/108–108.57, 273/119 R, 120 A, 126 R, 127 R, 129 S, 273/129 T, 129 V, 348.4, 317.2, 348.5, 405, 273/456, 118 A; 473/578
See application file for complete search history.

(56) References Cited

U.S. PATENT DOCUMENTS 1,926,980 A * 9/1933 Gorman ..... 273/108.22
2,463,197 A * 3/1949 Paupa ..... 273/317.2
2,477,531 A 7/1949 Volman
2,903,264 A * 9/1959 Munro et al. ..... 273/108.53
3,032,345 A * 5/1962 Lemelson ..... 273/348.4
3,721,447 A * 3/1973 Louderback ..... 473/235
3,857,566 A * 12/1974 Lemelson et al. ..... 273/348.4
3,870,308 A * 3/1975 Reilly ..... 273/126 A
3,997,162 A * 12/1976 Scullin ..... 273/348.3
4,244,576 A * 1/1981 Mosier et al. ..... 473/159
4,322,081 A * 3/1982 Terry et al. ..... 273/317.2
4,858,927 A * 8/1989 Simmons ..... 473/586
5,449,171 A * 9/1995 Makhoulian ..... 273/108.22
6,899,634 B2 * 5/2005 Hull et al. ..... 473/226
7,059,600 B2 * 6/2006 Jarimba ..... 273/108.2
7,364,164 B2 * 4/2008 Anasis et al. ..... 273/317.2

* cited by examiner

*Primary Examiner*—Sebastiano Passaniti
(74) *Attorney, Agent, or Firm*—LaMorte & Associates

(57) ABSTRACT

A game system that uses a swinging launcher to strike and propel a magnetic projectile. The magnetic projectile is propelled toward a primary target. If struck, the magnetic projectile clings to the primary target with magnetic attraction. Optional obstacles may be provided to make the striking of the primary target more difficult and the game more challenging. A tee is provided for placement of the magnetic projectile. The swinging launcher is spring loaded. The swinging launcher has a striking head that contacts the magnetic projectile on the tee when the spring loaded striking head is cocked and released. The striking head hits and separates the magnetic projectile from the tee thereby propelling the magnetic projectile toward the target.

15 Claims, 3 Drawing Sheets

NOVELTY GOLFING DEVICE HAVING MAGNETIC PROJECTILE

RELATED APPLICATIONS

This application is a continuation-in-part of U.S. Provisional Patent Application No. 60/999,174, entitled Novelty Golfing Device Having Spring Dart Projectile, filed Oct. 16, 2007.

BACKGROUND OF THE INVENTION

1. Field of the Invention

In general, the present invention relates to novelty games that simulate the game of golf. More particularly, the present invention relates to the structure of launchers, projectiles, and targets used in the game.

2. Prior Art Description

The prior art is replete with toys and games that utilize magnetized projectiles that are capable of sticking to metal surfaces. For instance, there are many magnetic dartboard games that use magnetic tipped darts in place of sharp pointed darts. Such games are exemplified by U.S. Pat. No. 2,477,531, entitled Magnetic Dart Game.

In such prior art games, the magnets are used at the front end of the projectile. The projectile is typically thrown or propelled by being placed within a spring-loaded launching mechanism. If a launching mechanism is used, the launching mechanism often contains no magnetic metals that react with the magnetic tip of the projectile. In this manner, there is no magnetic interaction between the projectile and the launcher that would detract from the launching of the projectile.

Since the magnetic within the projectile does not interact with the structure of the launcher, the magnet in the projectile does not help retain the projectile within the launcher.

In the present invention, a unique configuration is made between projectile and launcher that enables a magnet in the projectile to both adhere to a target and to assist during launching. The unique projectile and launcher system enables games to be configured and played in a manner not available through the prior art. The details of the game system are described and claimed below.

SUMMARY OF THE INVENTION

The present invention is a game system that uses a swinging launcher to strike and propel a magnetic projectile. The magnetic projectile is propelled toward a primary target. If struck, the magnetic projectile clings to the primary target with magnetic attraction. Optional obstacles may be provided to make the striking of the primary target more difficult and the game more challenging.

A tee is provided for placement of the magnetic projectile prior to being propelled toward the target. The magnetic projectile is magnetically attached to the tee when in contact with the tee.

The swinging launcher is spring loaded. The swinging launcher has a striking head that contacts the magnetic projectile on the tee when the spring loaded striking head is cocked and released. The striking head hits and separates the magnetic projectile from the tee thereby propelling the magnetic projectile toward the target.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention game system can be configured in many motifs, such as a hockey motif, football motif or soccer motif, it is particularly well suited for use in a golfing motif. Accordingly, the present invention system selected for illustration is configured with a golfing motif in order to present one of the best modes contemplated for the system. However, it will be understood that the illustrated embodiment is merely exemplary and should not be considered a limitation when interpreting the claims.

Figure 1:
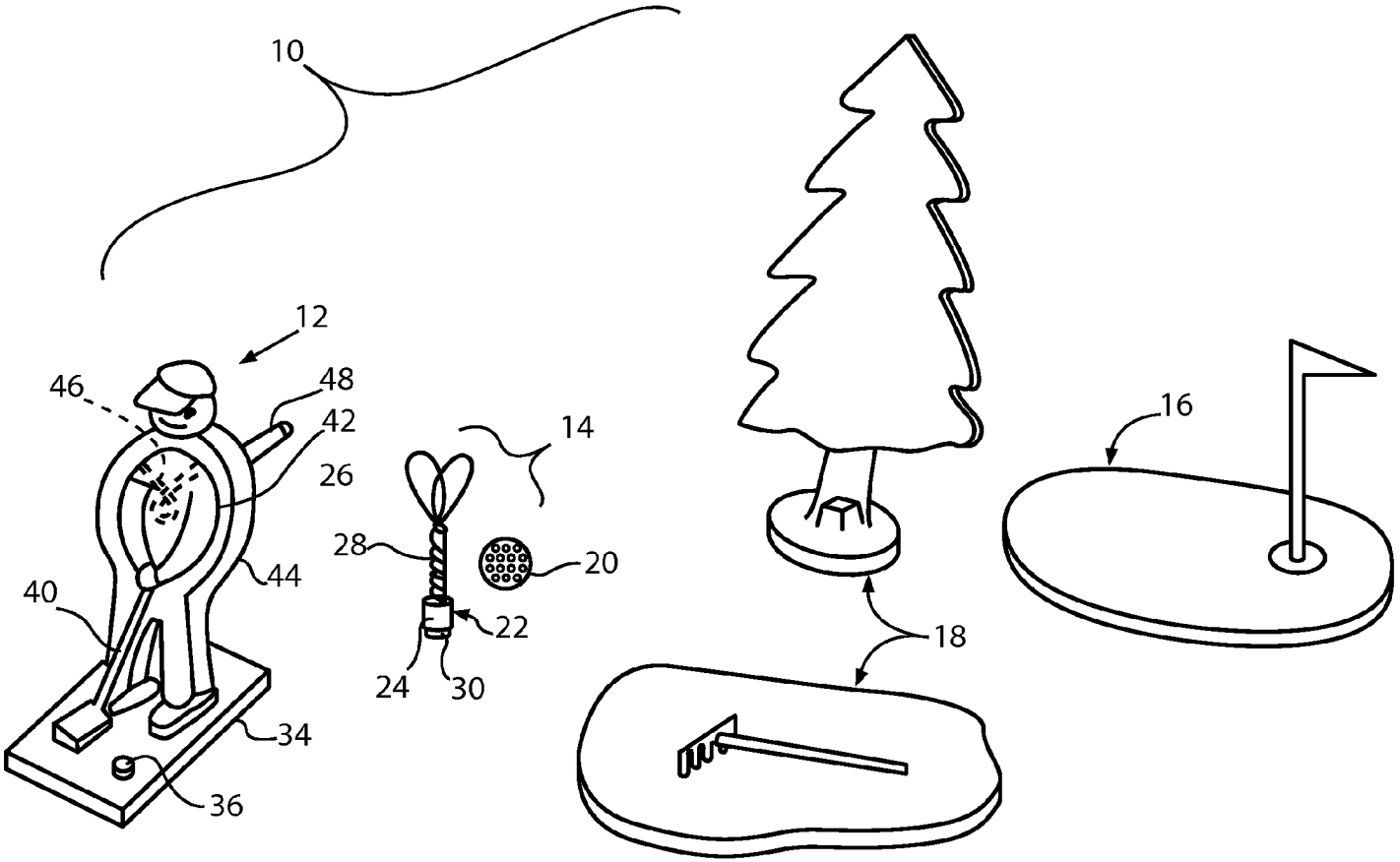
FIG. 1 is a perspective view of an exemplary embodiment of a game system.

Referring to FIG. 1, a first embodiment of a game system 10 is shown. The game system 10 is comprised of a toy golfer 12, a magnetic projectile 14, a primary target 16 and fairway obstacles 18.

In the embodiment of FIG. 1, two separate magnetic projectiles 14 are shown. One is configured as a golf ball 20. The other is configured as a dart 22. These two projectile types are exemplary and other shapes may be used. For the purposes of this specification, it should be understood that the term 'magnetic projectile' can be considered either the dart 22 or a spherical ball like the golf ball 20, since the two are functionally interchangeable within the game system 10.

The dart 22 has a head section 24 and a tail section 26. The head section 24 and the tail section 26 are joined together by a spring element 28. It will therefore be understood that the magnetic tipped dart 22 does not have a rigid shaft. Rather, the head section 24 and the tail section 26 can move independently of each other as the spring element 28 bends.

A high strength rare earth magnet 30 is set into the head section 24 of the dart 22. The rare earth magnet 30 creates a magnetic field strong enough to support the weight of the dart 22 and instantly cause the dart 22 to adhere to any ferrous and/or magnetized surface.

The golf ball 20 contains an internal magnet. The magnet can be fixed or free-floating within the interior of the golf ball 20. The shell of the golf ball 20 is plastic and does not affect the magnet contained therein. However, it will be understood that the golf ball 20 has a magnetic field strong enough to cause the golf ball 20 to instantly adhere to any ferrous surface.

It is preferred that a magnet me free-floating, i.e. loose, within the interior of the golf ball 20. In such a manner, the presence of the internal magnet will hamper the ability of the golf ball 20 to roll on a non-magnetic surface. In this manner, if the golf ball 20 misses the primary target 16 or obstacles 18, the golf ball will only roll a short distance before stopping.

Accordingly, it will be understood that if either the dart 22 or the golf ball 20 were to strike a magnetic surface, either projectile 14 would magnetically adhere to the point of impact.

In the shown embodiment, the primary target 16 is configured as a putting green in accordance with the motif of the game. Likewise, the obstacles 18 are configured as fairway obstacles. The primary target 16 and obstacles 18 are made from a ferro-magnetic material, such as tin or sheet metal. Alternatively, the primary target 16 and the fairway obstacles 18 can be coated with an iron impregnated polymer or magnetized material. Accordingly, when a magnetic projectile 14 contacts the primary target 16 or any obstacle 18, the magnetic projectile 14 sticks to the point of contact with magnetic attraction.

The primary target 16 can have any shape. Similarly, the obstacles 18 can be shaped as trees, sand traps, lakes and other such golfing traps. The obstacles 18 can lay flat or can have stands 32 that allow them to stand up vertically.

The toy golfer 12 rests upon a base 34. A tee 36 is present on the base 34. The tee 36 is ferro-magnetic and/or magnetized. Accordingly, the magnetic projectile 14 will magnetically attach to the tee 36 when placed upon the tee 36.

The toy golfer 12 holds a golf club 40. The golf club 40 is affixed to a rotatable hub 42. In the shown embodiment, the rotatable hub 42 is shaped as the arms and torso of the toy golfer 12. The remaining body 44 of the toy golfer 12 is fixed into a set position. The rotatable hub 42 contains a torsion spring 46 that biases the rotatable hub 42 into a fixed position relative to the body 44. However, the rotatable hub 42 can be rotated by applying a sufficient turning force to the hub 42 in opposition to the bias of the spring 46. A lever 48 extends from the rear of the hub 42 to facilitate the manual application of such a force to the hub 42. It will therefore be understood that by applying a force to the lever 48, the hub 42 can be turned in opposition to the spring 46. When the force is released, the hub 42 immediately rotates back into its original position.

The golf club 40 is oriented to pass just above the tee 36. The magnetic projectile 14 is placed on the tee 36. The magnetic projectile 14 stays in place on the tee because of the magnetic interaction between the magnetic projectile 14 and the tee 36. The golf club 40 is moved to a cocked position by turning the hub 42 with the lever 48. Once released, the golf club 40 swings and strikes the magnetic projectile 14 resting upon the tee 36.

Figure 2:
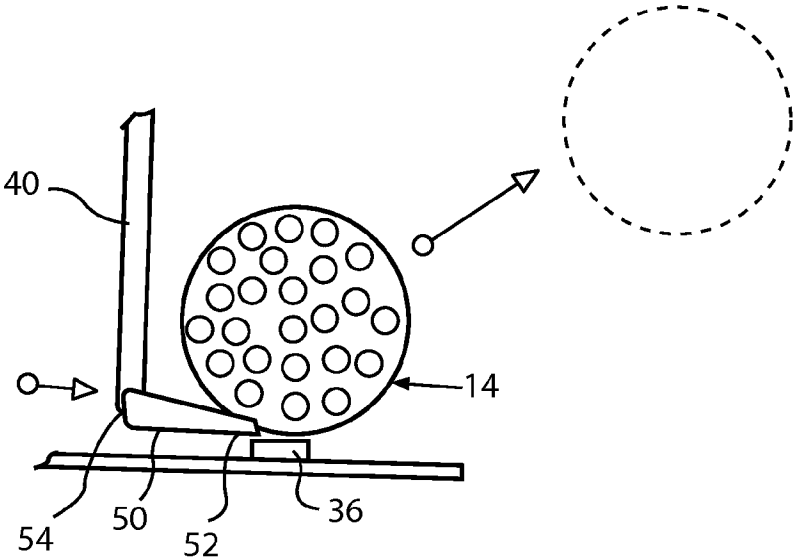
FIG. 2 is an enlarged view of the tee section of the exemplary embodiment.

Referring to FIG. 2 in conjunction with FIG. 1, it can be seen that the golf club 40 has a striking head 50 that is wedge shaped. The striking head 50 is narrow at its front edge 52 and wide at its rear edge 54. Accordingly, the top surface 56 of the striking head 50 is sloped. Once the golf club 40 is cocked and released, the front edge 52 of the striking head 50 contacts the magnetic projectile 14 at its point of contact with the tee 36. The striking head 50 separates the magnetic projectile 14 from the tee 36 as the top surface 56 of the striking head 50 passes under the magnetic projectile 14. The slope of the top surface 56 raises the magnetic projectile 14 away from the tee 36, thereby lessening the magnetic interconnection. The striking head 50 impacts the magnetic projectile 14 with enough speed to accelerate and launch the magnetic projectile 14 into the air. The wedge shape of the striking head 50 causes the magnetic projectile 14 to be launched both up and away from the tee 36.

If the magnetic projectile 14 is configured as a round golf ball 20, it will be understood that the point of impact and the shape of the striking head 50 causes the magnetic projectile 14 to spin backwardly or "with English" as it launches from the tee 36 and begins to fly.

The magnetic projectile 14 is aimed toward the primary target 16. The obstacles 18 are placed between the toy golfer 12 and the primary target 16. The object of the game is to strike the magnetic projectile 14 so that it reaches the primary target 16 without striking any of the intervening obstacles 18.

Figure 3:
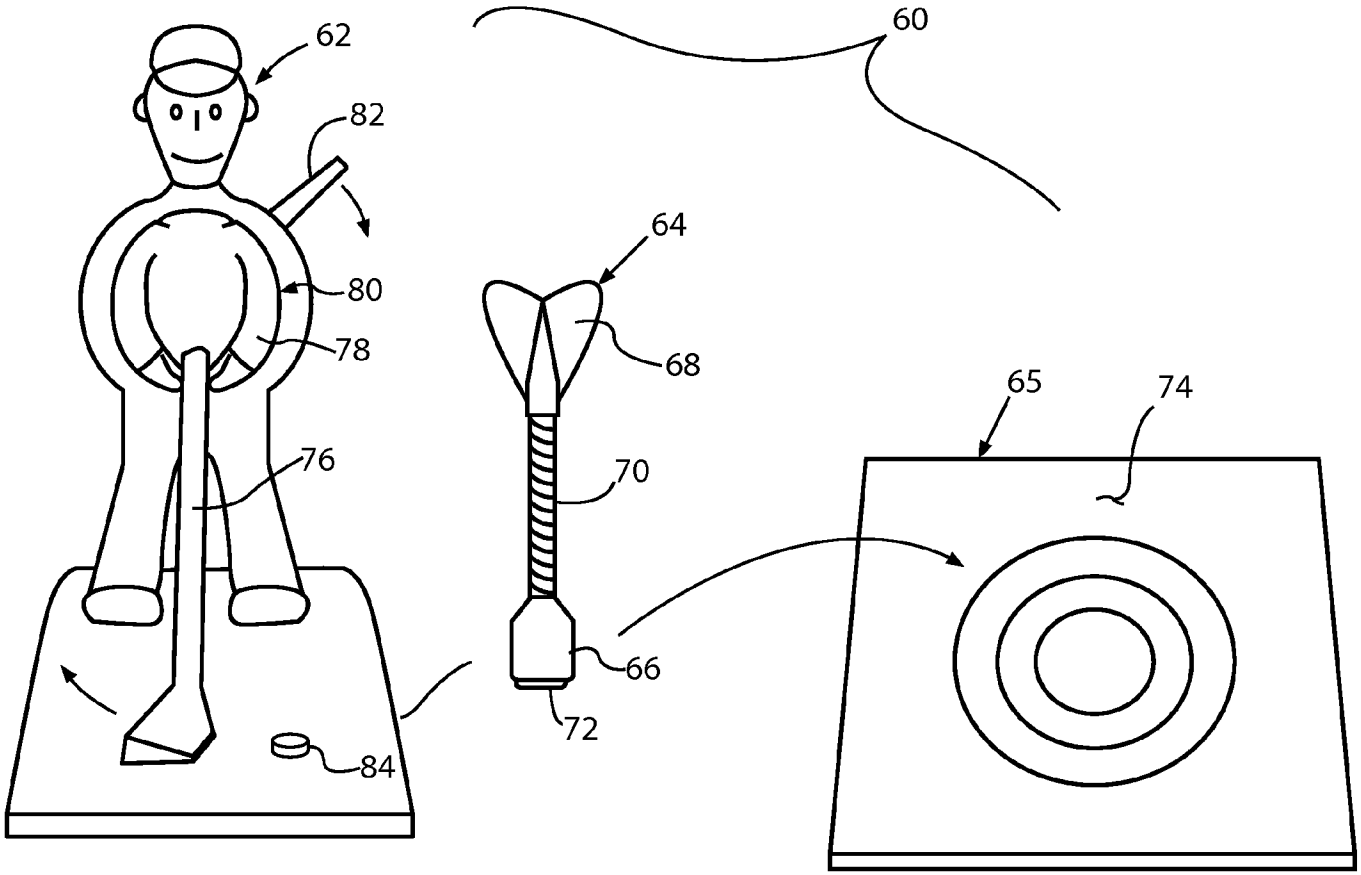
FIG. 3 is front view of an alternate embodiment of a game system.

Referring to FIG. 3, a variation of the present invention game system 60 is shown. In this variation, no obstacles are provided. Rather, the game system 60 is comprised of a toy golfer 62, a magnetic tipped dart 64 and a target 65.

The magnetic tipped dart 64 has a head section 66 and a tail section 68. The head section 66 and the tail section 68 are joined together by a spring element 70. It will therefore be understood that the magnetic tipped dart 64 does not have a rigid shaft. Rather, the head section 66 and the tail section 68 can move independently of each other as the spring element 70 bends.

A high strength rare earth magnet 72 is set into the head section 66 of the magnetic tipped dart 64. The rare earth magnet 72 creates a magnetic field strong enough to support the weight of the magnetic tipped dart 64 and instantly cause the magnetic tipped dart 64 to adhere to any ferrous surface.

The target 65 has a top surface 74 made from a ferromagnetic material, such as tin or sheet metal. Alternatively, the target 65 can be coated with an iron impregnated polymer. Accordingly, when the magnetic tipped dart 64 contacts the target 65, the magnetic tipped dart 64 sticks to the point of contact with magnetic attraction.

The target 65 can have any shape. In the shown embodiment a traditional bulls-eye shape is shown. However, the target 65 can be formed as a dartboard, a golf green or any other object. Additionally, the target 65 can lay flat or can stand up vertically. The magnetic tipped dart 64 is aimed toward the target 65. The object of the game is to strike the magnetic tipped dart 64 so that it reaches the target 65.

The novelty golfer 62 holds a club 76. The club 76 and the golfer's arms 78 are part of a rotating hub 80 that is positioned in the center of the novelty golfer 62. The rotating hub 80 is spring biased into a set position. The rotating hub 80 can be rotated out of that set position by manually manipulating a lever 82 that extends from the rear of the rotating hub 80. The club 76 is oriented to strike the head section 66 of the magnetic tipped dart 64, when the magnetic tipped dart 64 is placed on a tee 84.

Once the rotating hub 80 is cocked and released, the golf club 76 strikes the magnetic tipped dart 64, therein propelling the magnetic tipped dart 64 into flight. The spring element 70 enables the head section 66 of the magnetic tipped dart 64 to snap forward after detaching from the tee 84. This enables the magnetic tipped dart 64 to immediately assume a headfirst flight orientation as it flies toward the target 65.

It will be understood that the embodiments of the present invention that are illustrated and described are merely exemplary and that the game can be embodied in sport motifs other than golf. All such variations, modifications and alternate embodiments are intended to be included within the scope of the invention as defined by the claims.

What is claimed is:

1. A game system comprising:

a magnetic projectile;

a target, wherein said magnetic projectile magnetically attaches to said target when in contact with said target;

a tee for placement of said magnetic projectile prior to being propelled toward said target, wherein said magnetic projectile is magnetically attached to said tee at a contact point when said magnetic projectile is in contact with said tee; and a spring loaded striking head that strikes said magnetic projectile on said tee when said striking head is cocked and released, said striking head being wedge shaped, having a narrow front edge, a wide rear edge, and sloped top surface that extends between said narrow front edge and said wide rear edge, wherein said front edge of said striking head contacts said magnetic projectile proximate said contact point and separates said magnetic projectile from said tee, and said sloped top surface contacts and propels said magnetic projectile toward said target.

2. The system according to claim 1, further including a toy character, wherein said spring loaded striking head is supported by said toy character.

3. The system according to claim 2, wherein said toy character is positioned upon a freestanding base, wherein said tee is disposed on said base.

4. The system according to claim 2, wherein said striking head is configured as part of a golf club held by said toy character.

5. The system according to claim 1, wherein said magnetic projectile is spherical in shape.

6. The system according to claim 1, wherein said magnetic projectile is configured as a dart having a magnetic head, a tail and a body shaft that interconnects said head to said tail.

7. The system according to claim 6, wherein said body shaft is a coil spring.

8. The system according to claim 1, further including at least one obstacle that can be placed between said tee and said target, wherein said magnetic projectile is magnetically attached to said obstacle when in contact with said obstacle.

9. A game system, comprising:

a spring loaded toy golf club that swings between a cocked position and a striking position when manually cocked and released, said toy golf club having a wedge shaped head with a narrow front edge, a wide rear edge and sloped top surface extending between said narrow front edge and said wide rear edge;

a tee, wherein said striking position is immediately above said tee;

a target;

a magnetic projectile, wherein said magnetic projectile magnetically connects to said tee at a contact point when placed upon said tee, and wherein said front edge of said striking head contacts said magnetic projectile proximate said contact point when moving from said cocked position to said striking position, therein separating said magnetic projectile from said tee and bringing said magnetic projectile into contact with said sloped top surface, wherein said magnetic projectile launches toward said target, and wherein said magnetic projectile connects to said target when in contact with said target.

10. The system according to claim 9, further including a toy character, wherein said golf club is supported by said toy character.

11. The system according to claim 10, wherein said toy character is positioned upon a free standing base, wherein said tee is disposed on said base.

12. The system according to claim 9, wherein said magnetic projectile is spherical in shape.

13. The system according to claim 9, wherein said magnetic projectile is configured as a dart having a magnetic head, a tail, and a body shaft that interconnects said head to said tail.

14. The system according to claim 13, wherein said body shaft is a coil spring.

15. The system according to claim 9, further including at least one obstacle that can be placed between said tee and said target, wherein said magnetic projectile is magnetically attached to said obstacle when in contact with said obstacle.

* * * * *